US005665510A

United States Patent [19]

Hattori

[11] Patent Number: 5,665,510

[45] Date of Patent: Sep. 9, 1997

[54] TONER FOR ELECTROPHOTOGRAPH AND PROCESS FOR THE PRODUCTION THEREOF

[75] Inventor: Kazuyoshi Hattori, Shizuoka, Japan

[73] Assignee: Tomoegawa Paper Co., LTD., Tokyo, Japan

[21] Appl. No.: 533,832

[22] Filed: Sep. 26, 1995

[30] Foreign Application Priority Data

Sep. 29, 1994 [JP] Japan ..... 6-259090
Aug. 22, 1995 [JP] Japan ..... 7-236137

[51] Int. Cl.[6] ..... G03G 9/093
[52] U.S. Cl. ..... 430/109; 430/138
[58] Field of Search ..... 430/109, 138

[56] References Cited

U.S. PATENT DOCUMENTS 4,465,755 8/1984 Kiritani et al. ..... 430/109
5,294,513 3/1994 Mitchell et al. ..... 430/109

FOREIGN PATENT DOCUMENTS 59-177569 10/1984 Japan ..... 430/109
63-228171 9/1988 Japan ..... 430/109
2-101477 4/1990 Japan ..... 430/109

*Primary Examiner*—Roland Martin
*Attorney, Agent, or Firm*—Wenderoth, Lind & Ponack

[57] ABSTRACT

A toner for electrophotography, which contains a binder resin having a low softening point so that the toner can be fixed at a low temperature, and which is free from blocking, the toner comprising toner matrix particles containing a binder resin containing a resin having an epoxy group, and a colorant, and a cured coating formed from the resin having an epoxy group in the presence of a curing agent, the toner matrix particles being surface-covered with the cured coating.

7 Claims, No Drawings

TONER FOR ELECTROPHOTOGRAPH AND PROCESS FOR THE PRODUCTION THEREOF

FIELD OF THE INVENTION

The present invention relates to a toner for electrophotography and a process for the production thereof. More specifically, it relates to a toner for electrophotography particularly suitable for use with a copying machine or a printer for which a heat fixing method is adapted, and a process for the production thereof.

PRIOR ART OF THE INVENTION

In recent years, for copying machines and printers for which an electrophotographic method is adapted, it is required to decrease the heat fixing temperature for decreasing the consumption amount of electricity. For coping with this requirement, there are proposed toners containing binder resins whose molecular weights or molecular weight distributions are improved. Specifically, attempts have been made to decrease the molecular weight of a binder resin in order to decrease the fixing temperature. As the molecular weight of the binder resin decreases, the melting point decreases. However, the melt viscosity of the binder resin also decreases, which causes a problem in that an offset phenomenon occurs on a fixing, roll. For preventing the offset phenomenon, there is proposed a method in which the low molecular weight region and the high molecular weight region of molecular weight distribution of the binder resin are broadened, or a method in which a resin having a high molecular weight is crosslinked.

In the above methods, however, it is required to decrease the glass transition temperature of tile resin for achieving sufficient fixing property, and a decreased glass transition temperature causes a problem in that the toner is deteriorated in blocking property. That is, the problem is that a blocking occurs when the toner is stored at a high temperature, that the toner undergoes blocking to a carrier due to the friction between the carrier and the toner in a developing apparatus, or that the toner recovered in a cleaning process undergoes blocking. In a non-magnetic one-component development method, the toner is charged and formed into a layer on a sleeve by rubbing the toner with a blade. In this case, heat or a pressure is exerted on the toner, which causes a problem in that the toner undergoes blocking if the toner itself has insufficient heat or pressure resistance, and as a result, is greatly impaired in developability.

For improving the toner in the blocking property, there is known a surface modification method in which a fluidizing agent is added to the toner to cover the toner surface or fine particles of an organic or inorganic material are allowed to mechanically adhere to the toner surface. In these methods, however, it is difficult to completely cover the toner surface with the fluidizing agent or fine particles, and further, these surface covering materials deteriorate the fixing property and decrease the image density when increased in amount.

SUMMARY OF THE INVENTION

The present invention has been made in view of the above circumstances, and it is an object of the present invention to provide a long-life toner for electrophotography, which, contains a binder resin having a low softening point so that the toner can be fixed at a low temperature, and which is free from blocking.

According to the present invention, there is provided a toner for electrophotography, which comprises toner matrix particles containing a binder resin containing a resin having an epoxy group, and a colorant, and a cured coating formed from the resin having an epoxy group in the presence of a curing agent, the toner matrix particles being surface-covered with the cured coating.

According to the present invention, further, there is provided a process for the production of a toner for electrophotography, which comprises mixing toner matrix particles containing a binder resin containing a resin having an epoxy group and a colorant, with a curing agent, to prepare a mixture, and then, heat-treating the mixture, or applying a mechanical impact force on the mixture, to form a cured coating formed of the resin having an epoxy group on a surface of each of the toner matrix particles in the presence of the curing agent.

DETAILED DESCRIPTION OF THE INVENTION

The present invention will be explained in detail hereinafter.

Like conventional toners, the majority of the toner matrix particles used for the toner for electrophotography, provided by the present invention, are constituted of a binder resin. As a result, the binder resin has a great influence on the melting initiation temperature of tie toner. The toner for electrophotography, provided by the present invention, contains a binder resin containing a resin having an epoxy group. That is, the present invention includes two cases; in one case the binder resin is constituted of only a resin having an epoxy group, and in the other case the binder resin is constiuted of a resin having an epoxy group and a conventional binder resin.

The resin having an epoxy group, used in the toner for electrophotography in the present invention, is generally a bisphenol A type epoxy resin produced by the condensation of bisphenol A and epichlorohydrin. For example, the resin having an epoxy group is commercially available in the trade names of Epokoto YD-012, YD-013, YD-014, YD-017 and YD-020 (supplied by TOHOTO KASEI CO., LTD). An epoxy resin of other type may be also used as required. Further, an acrylic resin having an epoxy group, such as a graft polymer of an ethylene glycidyl methacrylate copolymer and a vinyl polymer, may be also used as a binder resin. Specific examples of the graft polymer of an ethylene glycidyl methacrylate copolymer and a vinyl polymer include Modiper A4100 (graft polymer of ethylene glycidyl methacrylate copolymer and polystyrene, amount ratio=70/30), Modiper A4200 (graft polymer of ethylene glycidyl methacrylate copolymer and polymethyl methacrylate, amount ratio=70/30) and Modiper A4400 (graft polymer of ethylene glycidyl methacrylate copolymer and acrylonitrile-styrene copolymer, amount ratio 70/30), each graft polymer being supplied by Nippon Oil & Fats Co., Ltd.

As described already, the present invention includes a case where a conventional binder resin is used in combination with the above resin having an epoxy group. The binder resin which may be used in combination with the above resin having an epoxy group includes polystyrene, a styrene-(meth)acrylate copolymer and a polyester. For decreasing the melting initiation temperature of the toner matrix particles in the present invention, it is preferred to use a resin having a molecular weight as low as possible. A resin having a low molecular weight has a lower melting initiation temperature than a resin having a high molecular weight, and a resin having a low glass transition temperature (Tg) has a lower melting initiation temperature than a resin having a high glass transition temperature. A resin having a low molecular weight and a low glass transition temperature is therefore suitable for use. For example, styrene-(meth) acrylate copolymers have an almost constant Tg when their molecular weights are about 5,000 or more, while the Tg greatly decreases when they have molecular weights lower than 5,000. In the present invention, for bringing the melting initiation temperature of the toner matrix particles into a proper range, it is preferred to select a binder resin so that the molecular weight and the glass transition temperature of the binder resin are brought into proper ranges.

In the present invention, as a binder resin, a styrene-(meth)acrylate copolymer may be used in combination with the resin having an epoxy group, as described above. Examples of the monomer as an acrylic component to constitute the styrene-(meth)acrylate copolymer include methyl acrylate, ethyl acrylate, propyl acrylate, n-butyl acrylate, isobutyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate and dimethylaminoethyl methacrylate.

Of the above monomers, n-butyl acrylate, n-butyl methacrylate and 2-ethylhexyl acrylate are particularly preferred, since it is easy to obtain a desired glass transition temperature (Tg).

In the styrene-(meth)acrylate copolymer, the ratio of styrene and methacrylate as monomers is determined depending upon the glass transition temperature which the copolymer is required to have. For example, in a styrene-n-butyl acrylate copolymer, the ratio of styrene/n-butyl acrylate as monomers is 70/30 to 85/15. In a styrene-n-butyl methacrylate copolymer, the ratio of styrene/n-butyl methacrylate as monomers is 25/75 to 60/40. In a styrene/2-ethylhexyl acrylate copolymer, the ratio of styrene/2-ethylhexyl acrylate as monomers is 80/20 to 90/10. When the amount of the (meth)acrylate is smaller than the above lower limit, the glass transition temperature and the melting initiation temperature of the toner matrix particles decrease to a level lower than necessary. The decrease in the melting initiation temperature to excess deteriorates the storage stability of the toner in summer. When the amount of the (meth)acrylate is larger than the above upper limit, undesirably, it is difficult to accomplish the low-temperature fixing which is an object of the present invention.

As a method of producing the binder resin containing a resin having an epoxy group, it is preferred to employ a method in which polymerizable monomers, i.e., styrene and (meth)acrylate are solution-polymerized in the presence of the resin having an epoxy group. In this method, the dispersibility of the resin having an epoxy group is improved. As a result, epoxy groups, i.e., reactive points are uniformly present on the surface of the toner matrix particles, and a cured coating is therefore uniformly formed. As a result, the resultant toner is free from undergoing blocking.

The epoxy equivalent of the binder resin used in the present invention is 500 to 20,000 g/eq, preferably 500 to 13,000 g/eq, more preferably 1,000 to 5,000 g/eq. When the epoxy equivalent is less than the above lower limit, it is difficult to pulverize the binder resin when the toner is produced, since the softening point of the binder resin is too low. When the epoxy equivalent is larger than the above upper limit, undesirably, the effect on preventing the blocking decreases, since the number of the epoxy groups on the toner surface is too small.

When the conventional binder resin is used in combination with the resin having an epoxy group, preferably, the amount of the resin having an epoxy group is determined such that the binder resin containing the resin having an epoxy group and the conventional binder resin has an epoxy equivalent in the above range. For example, when the conventional binder resin is a styrene/(meth)acrylate copolymer, the amount of the resin having an epoxy group is 1 to 80 parts by weight per 100 parts by weight of the copolymer. When the amount of the resin having an epoxy group in this case is less than 1 part by weight, undesirably, the number of epoxy groups on the toner surface is small, and the effect on preventing the blocking is poor. When the above amount exceeds 80 parts by weight, undesirably, an offsetting is liable to occur at the time of fixing at a high temperature.

The toner matrix particles constituting the toner for electrophotography, provided by the present invention, contains a colorant in addition to the above binder resin, and the toner matrix particles may further contain a charge control agent and other additive as required.

The colorant used in the above toner matrix particles includes carbon black, Nigrosine dye, Aniline Blue, Calcooil Blue, Chromium Yellow, Ultramarine Blue, du Pont Oil Red, Quinoline Yellow, Methylene Blue-Chloride, Phthalocyanine Blue, Malachite Green Oxalate, lamp black, ROSE Bengale, etc. These colorants may be used alone or in combination. The colorant is required to be contained in an amount sufficient for forming a visible image having a sufficient image density. Generally, the amount of the colorant is approximately 1 to 20 parts by weight per 100 parts by weight of the binder resin. When the amount of the colorant is less than 1% by weight, the image density is insufficient. When the above amount exceeds 20 parts by weight, undesirably, the image density does not increase any further, and here are caused adverse effects such as a deteriorating effect on the fixing property.

The charge control agent is selected from conventional charge control agents such as Nigrosine Dye, quaternary ammonium salt, and triphenyl methane-containing and monoazo-containing metal complex dyes.

The other additive which is incorporated as required includes fluidizing agents such as fine resin particles, hydrophobic silica and colloidal silica.

In the present invention, the binder resin is selected from epoxy resins or combinations of general resins with epoxy resins, so that the melting initiation temperature of the toner matrix particles can be brought into a proper temperature range lower than the melting initiation temperature, 110° C., of a conventional toner. More specifically, the melting initiation temperature of the toner matrix particles is 100° C. or lower. However, when the melting initiation temperature of the binder resin is decreased to a level lower than necessary, e.g., lower than 60° C., it is undesirable in terms of storage, since the toner is softened in summer.

The melting initiation temperature is therefore required to be at least 60° C. In the present invention, therefore, the melting initiation temperature of the binder resin used in the toner matrix particles is preferably in a range in which the toner can be fixed on a receptor sheet (paper) at a low temperature and the toner can be stably stored, i.e., in the range of from 60° C. to 100° C.

The toner for electrophotography, provided by the present invention, is produced by preparing a binder resin containing a resin having an epoxy group and optionally other binder resin, incorporating a pigment into the binder resin to form toner matrix particles, mixing a curing agent such as an amine with the toner matrix particles and then reacting the curing agent with the resin having an epoxy group present on surfaces of the toner matrix particles to form a cured coating on the surfaces of the toner matrix particles.

That is, the binder resin containing at least a resin having an epoxy group, a colorant, a charge control agent, and optionally other additive are mixed in a desired mixing ratio, and the mixture is melt-kneaded. The kneaded mixture is cooled to solidness, and the resultant solid is pulverized and classified to obtain toner matrix particles. In the preparation of the toner matrix particles, a polymerizable resin may be used as a binder resin other than the resin having an epoxy group, and raw materials such as the binder resin having an epoxy group, a colorant, a charge control agent, etc., may be incorporated when the above polymerizable resin is polymerized. A toner obtained by incorporating raw materials when a polymerizable resin as a binder resin is polymerized, is a so-called polymerization method toner. Then, the above-obtained toner matrix particles are mixed with a curing agent such as an amine to prepare a mixture, and the mixture is treated by the method to be described later, whereby a toner having a cured coating formed by curing the resin having an epoxy group present on surfaces of the toner matrix particles, i.e., the toner for electrophotography, provided by the present invention, is obtained.

In the above process for the production of the toner for electrophotography, the above binder resin containing a resin having an epoxy group and other binder resin, the above colorant, the charge control agent, and the optionally incorporated other additive are the same as those explained with regard to the toner for electrophotography, provided by the present invention.

The curing agent used in the present invention includes amines such an an aliphatic polyamine, a urea melamine formaldehyde condensate, aliphatic acids and their anhydrides, alicyclic acids and their anhydrides, aromatic acids and their anhydrides, halogenated acids and their anhydrides, halogenated boron complex salts, organic tin compounds, polythiol, phenol and its derivatives, isocyanate, ketimine, and imidazole and its derivatives. Of these curing agents, amines are preferred in terms of low reaction temperature, high reactivity and suitability to positive triboelectric charge.

Examples of the amines which come under the curing agent used for the toner for electrophotography, provided by the present invention, include ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetramine, diethylaminopropylamine, tetraethylenepentamine, diaminodiphenylmethane, diaminodiphenylsulfone, m-xylenediamine, m-aminobenzylamine, benzidine, 4-chloro-o-phenylenediamine, bis(3,4-diaminophenyl) sulfone, 2,6-diaminopyridine, methylenedianiline, 3,3'-dimethyl-4,4'-diamino-dicylcohexylmethane, N-aminoethylpiperazine, a 3,9-bis(3-aminopropyl)-2,4,8,10-tetraoxopyro-[5,5]-undecane modified product, benzyldimethylamine, and 2,4,6-tridimethylaminomethylphenol.

The amount of the curing agent incorporated into the toner for electrophotography is 0.01 to 10% by weight, more preferably 0.03 to 5% by weight. When the amount of the curing agent is less than 0.01% by weight, undesirably, no coating effect is exhibited since the thickness of the coating is too small, and a blocking is liable to occur. When the above amount is larger than 10% by weight, undesirably, the fixing property of the toner is low. When the above amount is in the range of 0.0 3 to 5% by weight in particular, more preferably, the toner is almost free from the occurrence of the above problems.

The cured coating of the resin having an epoxy group is formed on surfaces of the toner matrix particles by the following method. That is, for curing the mixture containing the curing agent such as an amine or the like and the resin having an epoxy group, it is required to treat the above mixture under heat or apply a mechanical impact force to the mixture. The means for the heat treatment can be selected from a super mixer, a Henschel mixer and a turbulizer. When the mixture is stirred in any one of these mixers, friction heat is generated on the surfaces of the toner matrix particles so that the reaction proceeds. For further promoting the reaction, the mixture may be heated by circulating hot water through a jacket of the mixer or by blowing in hot air. Further, there may be used a surfusing system using a method of modification in hot air current (supplied by Nippon Pneumatic MFG Co., Ltd.).

On the other hand, a variety of apparatus can be used for applying a mechanical impact force to the mixture. Although not specially limited, the means therefor can be suitably selected, for example, from apparatus such as a hybridization system using a method of impact application in high-speed air current (supplied by Nara Machinery Co., Ltd.), a cosmo system (supplied by Kawasaki Heavy Industries, Ltd.), a mechanofusion system using a dry method mechanochemical method (Hosokawa Micron Corporation), and a mechanomill (Okada Seiko Co., Ltd.).

The melting initiation temperature used in the present invention refers to a temperature at which a plunger starts to go down under the following measurement conditions.

Measuring apparatus: Koka type flow tester CFT-500, supplied by Shimadzu Corporation.

| Measurement conditions: | |
|---|---|
| Plunger | 1 $cm^2$ |
| Diameter of die | 1 mm |
| Length of die | 1 mm |
| Load | 20 kgF |
| Preliminary heating temperature 50–80° C. | |
| Preliminary heating time 300 sec. | |
| Temperature elevation rate 6° C./min. | |

The toner for electrophotography, provided by the present invention, refers to particles which are formed of toner matrix particles containing the above binder resin containing at least a resin having an epoxy group and the above colorant and optionally containing a dispersion of the above charge control agent, a releasing agent and a magnetic material, and have cured coatings formed on their surfaces by curing the resin having an epoxy group with the above curing agent such as an amine. The toner for electrophotography, provided by the present invention, has an average particle diameter in the range of from 5 to 20 μm. The toner for electrophotography, provided by the present invention, may be constituted by adding and mixing a fluidity improving agent such as a silica fine powder to/with the above particles. The fluidity improving agent may be replaced with a known agent such as a resin fine powder, hydrophobic silica or colloidal silica.

The toner for electrophotography, provided by the present invention, may be used as a two-component developer prepared by mixing it with a carrier such as an iron powder, ferrite or granulated magnetite, or may be used as a magnetic or nonmagnetic one-component developer containing no carrier.

The toner for electrophotography, provided by the present invention, has a coating of a resin having an epoxy group cured by the curing agent such as an amine, on surfaces of toner matrix particles which contain the binder resin containing at least a resin having an epoxy group and a colorant, and have a melting initiation temperature of 60° C. to 100° C. As a result, even when the toner is placed in an environment where the temperature of the binder resin constituting most part of the toner weight is increased to a level higher than its glass transition temperature due to heat, the toner is free from undergoing blocking, and the toner has a fixing temperature considerably lower than the fixing temperature of a conventional toner.

The present invention will be explained in detail hereinafter with reference to Examples, in which "part" stands for "part by weight".

EXAMPLE 1

Toner matrix particles having the following composition were prepared.

| | |
|---|---|
| Styrene-acrylate copolymer resin (monomer composition: styrene/butyl acrylate) | 100 parts |

High-molecule-weight copolymer
$Mw=3.0\times10^6$
$Mn=1.0\times10^6$
Low-molecular-weight copolymer
$Mw=8.0\times10^3$
$Mn=2.7\times10^3$
Low-molecular-weight copolymer/high-molecular-weight copolymer=70:30

| | |
|---|---|
| Bisphenol A type epoxy resin (trade name: YD-012, supplied by Tohto Kasei Co., Ltd.) | 40 parts |
| Carbon black (trade name: MA-100, supplied by Mitsubishi Chemical Corporation) | 6.5 parts |
| Quaternary ammonium salt (trade name: P-51, supplied by Orient Chemical Industries, Ltd.) | 2 parts |
| Polyethylene (trade name: PE-130, supplied by Hoechst Japan) | 3 parts |

The measurement conditions of gel permeation chromatography (GPC) were as follows: Column temperature: 40° C., solvent: tetrahydrofuran, flow rate: 1 mm/min., sample concentration: 0.2%, sample amount: 100 μl, column constitution: 2 KF-80M columns+KF-802.5 column (all supplied by Shodex).

The toner matrix particles were prepared as follows. The above raw materials were mixed with a super mixer, melt-kneaded, pulverized and classified to give positively triboelectrical toner matrix particles (A) having an average particle diameter of 11 μm (epoxy equivalent of the binder resin=1,625 g/eq). The so-obtained toner matrix particles had a melting initiation temperature 95° C.

A cured coating of the epoxy resin was formed on surfaces of the above-obtained toner matrix particles (A) in the presence of an amine as a curing agent as follows.

0.05 Part of diethylenetriamine (reagent special grade) was added to 100 parts of the above-obtained toner matrix particles (A), and the mixture was stirred in a Henschel mixer to uniformly disperse the amine on the surfaces of the toner matrix particles (A). The resultant mixture in which the amine was dispersed was charged into a hybridization system NHS-1 (supplied by Nara Machinery Co., Ltd.) and treated at a blade tip peripheral rate velocity of about 80 cm/second for 10 minutes to give a toner for electrophotography of which the toner matrix particle surfaces were cured.

EXAMPLE 2

A toner for electrophotography was obtained in the same manner as in Example 1 except that the amount of the diethylene triamine was changed to 0.5 part.

EXAMPLE 3

A toner for electrophotography was obtained in the same manner as in Example 1 except that the amount of the diethylene triamine was changed to 1.0 part.

EXAMPLE 4

A toner for electrophotography was obtained in the same manner as in Example 1 except that the amount of the diethylene triamine was changed to 5.0 parts.

EXAMPLE 5

A toner for electrophotography was obtained in the same manner as in Example 1 except that the amount of the diethylene triamine was changed to 15.0 parts and that the time for the treatment with the hybridization system NHS-1 was changed to 30 minutes.

EXAMPLE 6

A toner for electrophotography was obtained in the same manner as in Example 1 except that 0.05 part of the diethylene triamine was replaced with 1.0 part of a modified alicyclic polyamine (Epomate RX-221, supplied by Yuka-Shell Epoxy Kabushiki Kaisha).

EXAMPLE 7

<Preparation of binder resin>

600 Parts of xylene and 40 parts of an epoxy resin (Epotohto YD-012, supplied by Tohto Kasei Co., Ltd.) were placed in a flask and dissolved. A gas in the flask was replaced with nitrogen gas, and then the mixture was heated up to the boiling point of xylene. While the xylene was refluxed, a mixture containing 13 parts of styrene, 5 parts of n-butyl acrylate and 0.3 part of benzoyl peroxide (polymerization initiator) was added dropwise with stirring over 1 hour, to carry out a solution polymerization. After the addition of the mixture finished, the reaction mixture was aged under the reflux of xylene with stirring for 6 hours, to give a high-molecular-weight polymer having an Mw of $3.0\times10^6$ and an Mn of $1.0\times10^6$. Then, a mixture containing 32 parts of styrene, 10 parts of n-butyl acrylate and 3 parts of benzoyl peroxide was dropwise added to the above high-molecular-weight polymer in the above flask over 2 hours, to carry out a solution polymerization. After the addition of the mixture finished, the reaction mixture was aged under the reflux of xylene with stirring for 1 hour, to give a low-molecular-weight polymer having an Mw of $8.0\times10^3$ and an Mn of $2.7\times10^3$ in addition to the above high-molecular-weight polymer. That is, the obtained polymer had a molecular weight distribution having two peaks. Then, while the temperature in the flask was gradually increased up to 180° C., the xylene was removed under reduced pressure, to give a binder resin (B) (epoxy equivalent: 1,625 g/eq). The above molecular weight values were determined by GPC.

<Preparation of toner matrix particles>

Toner matrix particles having the following composition were prepared using the binder resin (B).

| | |
|---|---|
| Binder resin (B) | 100 parts |
| Carbon black (trade name: MA-100, supplied by Mitsubishi Chemical Corporation) | 6.5 parts |
| Quaternary ammonium salt (trade name: P-51, supplied by Orient Chemical Industries, Ltd.) | 2 parts |
| Polyethylene (trade name: PE-130, supplied by Hoechst Japan) | 3 parts |

The above raw materials were mixed with a super mixer, melt-kneaded, pulverized and classified to give positively triboelectrical toner matrix particles (B) having an average particle diameter of 11 μm. The so-obtained toner matrix particles (B) had a melting initiation temperature of 89° C. Thereafter, a toner for electrophotography was obtained in the same manner as in Example 2 except that the toner matrix particles (A) were replaced with the toner matrix particles (B).

EXAMPLE 8

A binder resin (C) (epoxy equivalent: 12,500 g/eq) was obtained in the same manner as in Example 1 except that the epoxy resin YD-012 was replaced with an epoxy resin YD-020 (supplied by Tohto Kasei Co., Ltd.). Then, toner matrix particles (C) were obtained in the same manner as in Example 1. Thereafter, a toner for electrophotography was obtained in the same manner as in Example 2 except that the toner matrix particles (A) were replaced with the toner matrix particles (C).

Comparative Example 1

A comparative toner for electrophotography was obtained in the same manner as in Example 1 except that no diethylenetriamine was used.

Comparative Example 2

Toner particles containing diethylenetriamine and having the following composition were prepared.

| | |
|---|---|
| Styrene-acrylate copolymer resin (monomer composition: styrene/butyl acrylate) | 100 parts |

High-molecular-weight copolymer $Mw=3.0\times10^6$ $Mn=1.0\times10^6$

Low-molecular-weight copolymer $Mw=8.0\times10^3$ $Mn=2.7\times10^3$

Low-molecular-weight copolymer/high-molecular-weight copolymer=70:30

| | |
|---|---|
| Bisphenol A type epoxy resin (trade name: YD-012, supplied by Tohto Kasei Co., Ltd.) | 40 parts |
| Diethylenetriamine (reagent of special grade) | 5 parts |
| Carbon black (trade name: MA-100, supplied by Mitsubishi Chemical Corporation) | 6.5 parts |
| Quaternary ammonium salt (trade name: P-51, supplied by Orient Chemical Industries, Ltd.) | 2 parts |
| Polyethylene (trade name: PE-130, supplied by Hoechst Japan) | 3 parts |

The above raw materials were mixed with a super mixer, melt-kneaded, pulverized and classified to give positively chargeable toner matrix particles (D) having an average particle diameter of 11 μm. The so-obtained toner matrix particles (D) had a melting initiation temperature of 93° C. A comparative toner for electrophotography was obtained in the same manner as in Example 1 except that the toner matrix particles (A) were replaced with the toner matrix particles (D) and that no diethylene triamine was added.

Before the evaluation of the toners obtained in Examples 1 to 8 and Comparative Examples 1 and 2, 0.3 part of hydrophobic silica (TS-530, supplied by Cabot) was added to 100 parts of each toner.

Then, the resultant toners were evaluated as follows.

(1) Blocking property

20 Grams of a toner sample was filled in a 150 cc bottle, and allowed to stand in a constant-temperature chamber at 50° C. for 48 hours. Then, the toner was shaken on a 60-mesh sieve with a powder tester type: PT-E supplied by Hosokawa Micron Corporation at an amplitude of 1 mm for 10 seconds, and the remainder on the sieve was measured for a weight.

(2) Fixing property

5 Parts of a toner sample and 95 parts of a ferrite carrier (trade name: FL-100, supplied by Powder Tech Co., Ltd.) were mixed to prepare a two-component developer. The so-prepared developer was evaluated for a fixing-property of the toner with a copying machine (BD-2810, supplied by Toshiba Corporation) as follows.

The heat roller temperature of the above copying machine was set at 130° C., and an image obtained by fixing the toner was measured for an image density (A). Then, an eraser was rubbed against the image, and the resultant image was measured for an image density (B). The fixing property was determined in terms of the remaining ratio (%) based on the following equation.

$$\text{Remaining ratio (\%)}=(B/A)\times100$$

The above image density measurement was carried out with a Macbeth reflection densitometer (trade name: RD-914, supplied by Macbeth).

(3) Image property

The same developer as that in the above (2) and the same copying machine as that in the above (2) were used. to make 5,000 copies in the continuous operation at 25° C. at an RH of 60%. Then, an image on the first copy and an image on the 5,000th copy were measured for image density (I.D) and a background (B.G) on a non-image portion with the above Macbeth reflection densitometer and a color and color difference meter (model Z-1001DP, supplied by Nippon Denshoku Kogyo).

Table 1 shows the results.

TABLE 1

| | Blocking property | Fixing | Initial copy | | Last copy | |
|---|---|---|---|---|---|---|
| | Weight of remainder (g) | property (%) | Image density | Back-ground | Image density | Back-ground |
| Ex. 1 | 1.02 | 83 | 1.42 | 0.3 | 1.40 | 0.5 |
| Ex. 2 | 0.28 | 82 | 1.42 | 0.3 | 1.39 | 0.6 |
| Ex. 3 | 0.30 | 80 | 1.43 | 0.4 | 1.38 | 0.6 |
| Ex. 4 | 0.25 | 76 | 1.43 | 0.4 | 1.39 | 0.6 |
| Ex. 5 | 0.31 | 70 | 1.42 | 0.3 | 1.38 | 0.5 |
| Ex. 6 | 0.65 | 79 | 1.42 | 0.3 | 1.38 | 0.5 |
| Ex. 7 | 0.08 | 83 | 1.41 | 0.3 | 1.39 | 0.5 |
| Ex. 8 | 0.98 | 71 | 1.40 | 0.4 | 1.37 | 0.7 |
| CEx. 1 | * 84 | 1.42 | 0.3 | 1.41 | 0.5 | |
| CEx. 2 | 15.42 | 52 | 1.40 | 0.5 | 1.36 | 0.7 |

Ex. = Example,
CEx. = Comparative Example
*Complete blocking occurred.

The results in the above Table 1 show that the toners obtained in Examples 1 to 8 had melting initiation temperatures lower than that of a conventional toner, while they were excellent in anti-blocking property.

That is, the toner for electrophotography, provided by the present invention, has a cured coating of an epoxy resin on the surfaces of toner matrix particles, so that the binder resin in one particle is out of contact with the binder resin in another particle even if the binder resin constituting almost all of the toner weight softened under heat. As a result, the occurrence of blocking is sufficiently prevented.

Table 1 shows that the toners for electrophotography, obtained in Examples 1 to 8, had practically sufficient fixing strength to a receptor sheet at a low temperature as low as 130° C.

Further, Table 1 also shows that the toners for electrophotography, obtained in Examples 1 to 8, exhibited sufficient image density and practically sufficient freedom from background up to about 5,000th copy.

It was also found that when the toners for electrophotography, obtained in Examples 1 to 8, were used, no toner was fused onto that sleeve or blade of the copying machine which exerted pressure on the toner.

The toner for electrophotography, provided by the present invention is free from a blocking problem, can be fixed at a low temperature, shows excellent fixing strength and gives a great number of copies having sufficient image density. When the toner of the present invention is used with a copying machine or a printer, the consumption amount of electricity can be reduced, and the copying speed can be increased.

What is claimed is:

1. A toner for electrophotography produced by the process which consists essentially of mixing toner matrix particles containing a binder resin having an epoxy group and a colorant with a curing agent to form a mixture, heat-treating said mixture or applying a mechanical impact force on the mixture to thereby form a cured coating of the resin having an epoxy group and the curing agent on the surface of each of the toner matrix particles.

2. A toner according to claim 1, wherein the toner has a melting initiation temperature in the range of from 60° C. to 100° C.

3. A toner according to claim 1, wherein the curing agent is an amine.

4. A toner according to claim 3, wherein the toner is positively triboelectrical.

5. A toner according to claim 1, wherein the binder resin containing a resin having an epoxy group is a product obtained by solution-polymerizing polymerizable monomers of styrene and (meth)acrylate in the presence of the resin having an epoxy group.

6. A toner according to claim 1, wherein the binder resin containing a resin having an epoxy group has an epoxy equivalent of 500 to 20,000 g/eq.

7. A toner according to claim 1 wherein the binder resin is formed from a resin having an epoxy group and a styrene/(meth)acrylate copolymer containing a styrene/(meth)acrylate copolymer having a high molecular weight and a styrene/(meth)acrylate copolymer having a low molecular weight.

* * * * *